US005379826A

United States Patent [19]

Miwa et al.

[11] Patent Number: 5,379,826

[45] Date of Patent: Jan. 10, 1995

[54] APPARATUS FOR DETECTING DEFECTS AT GAS EXHAUST LINE IN CASTING MACHINE AND METHOD THEREFOR

[75] Inventors: Tomoyoshi Miwa; Hitoshi Ishida; Noriyoshi Yamauchi, all of Fuchu, Japan

[73] Assignee: Ryobi Ltd., Hiroshima, Japan

[21] Appl. No.: 131,386

[22] Filed: Oct. 5, 1993

[30] Foreign Application Priority Data

Oct. 9, 1992 [JP] Japan ..... 4-297647

[51] Int. Cl.[6] ..... B22D 17/32

[52] U.S. Cl. ..... 164/4.1; 164/113; 164/305; 164/151

[58] Field of Search ..... 164/305, 113, 4.1, 150, 164/154, 151

[56] References Cited

U.S. PATENT DOCUMENTS 5,086,824 2/1992 Tsuda et al. ..... 164/4

FOREIGN PATENT DOCUMENTS 62-137164 6/1987 Japan .
62-193952 12/1987 Japan .

OTHER PUBLICATIONS

*Patent Abstracts of Japan,* vol. 10, No. 174 (M-490) 2230, Jun. 19, 1986 (JP-A-61 023 561).
*Patent Abstracts of Japan,* vol. 9, No. 330 (M-442) (2053), Dec. 25, 1985 (JP-A-60 162 566).
*Patent Abstracts of Japan,* vol. 11, No. 360 (M-645), Nov. 25, 1987 (JP-A-62 137 164).

*Primary Examiner*—Kuang Y. Lin
*Attorney, Agent, or Firm*—Sughrue, Mion, Zinn, Macpeak & Seas

[57] ABSTRACT

A gas venting system is connected to a downstream side of a gas vent valve through a gas exhaust line. An electromagnetic valve and a suction unit are connected to the gas exhaust line. A pressure switch is directly connected to the gas exhaust line to detect the pressure variation within the line. By the suction through the suction unit and the opening of the electromagnetic valve, the gas exhaust line is decompressed. If the line has a perforation, the pressure does not reach a predetermined pressure. If clogging occurs, the pressure reaches a predetermined pressure while the metal molds are open and the gas vent valve is open. Thus, accurate detection to the defects can be achieved regardless of the state of the metal molds and the internal volume of a vacuum tank.

6 Claims, 2 Drawing Sheets

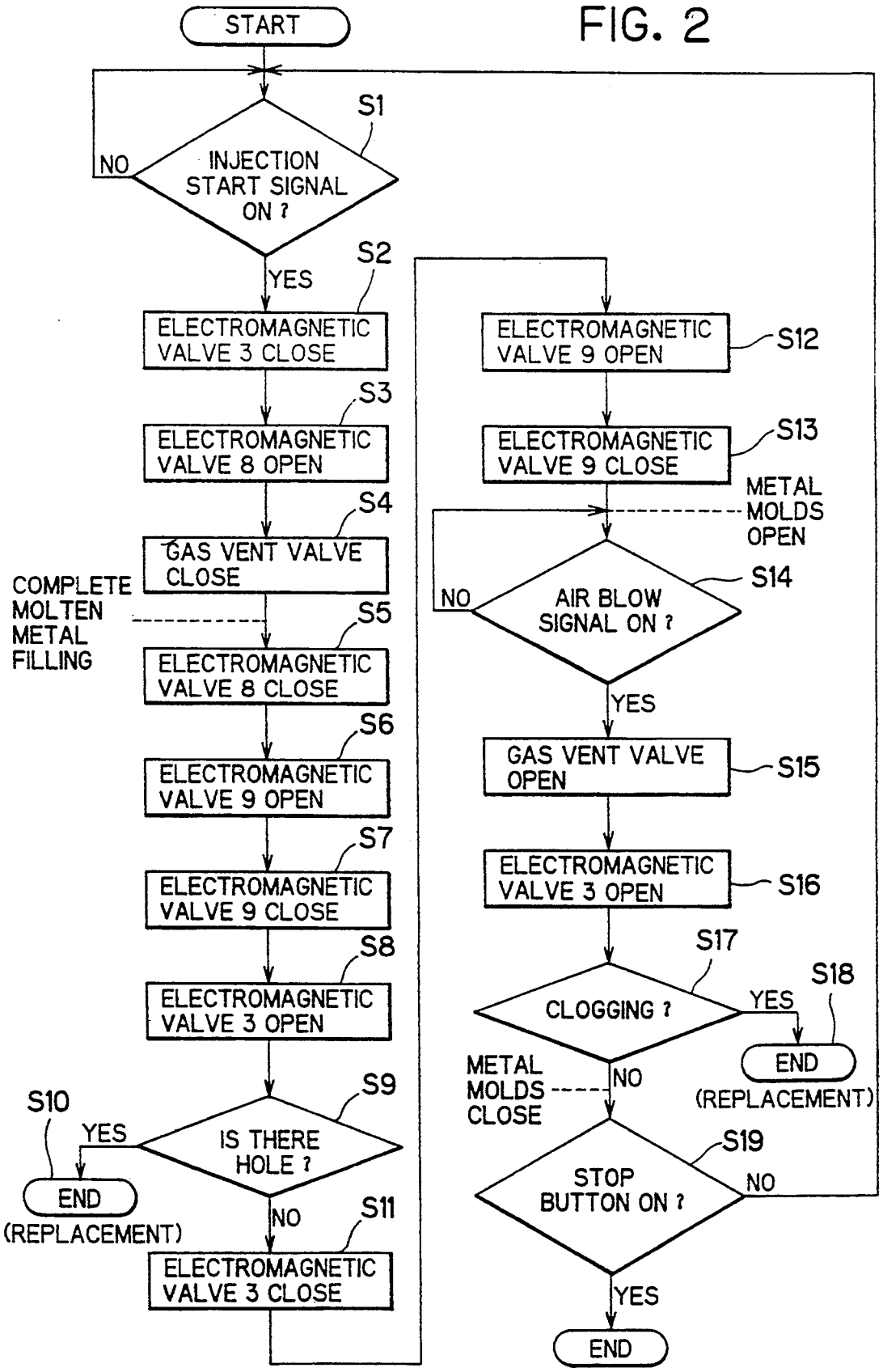
FIG. 2
START
S1
INJECTION START SIGNAL ON ?
NO
YES
S2
ELECTROMAGNETIC VALVE 3 CLOSE
S3
ELECTROMAGNETIC VALVE 8 OPEN
S4
GAS VENT VALVE CLOSE
COMPLETE MOLTEN METAL FILLING
S5
ELECTROMAGNETIC VALVE 8 CLOSE
S6
ELECTROMAGNETIC VALVE 9 OPEN
S7
ELECTROMAGNETIC VALVE 9 CLOSE
S8
ELECTROMAGNETIC VALVE 3 OPEN
S9
IS THERE HOLE ?
S10
YES
END
(REPLACEMENT)
NO
S11
ELECTROMAGNETIC VALVE 3 CLOSE
ELECTROMAGNETIC VALVE 9 OPEN
S12
ELECTROMAGNETIC VALVE 9 CLOSE
S13
METAL MOLDS OPEN
S14
AIR BLOW SIGNAL ON ?
NO
YES
GAS VENT VALVE OPEN
S15
ELECTROMAGNETIC VALVE 3 OPEN
S16
S17
CLOGGING ?
YES
S18
END
(REPLACEMENT)
METAL MOLDS CLOSE
NO
S19
STOP BUTTON ON ?
NO
YES
END

APPARATUS FOR DETECTING DEFECTS AT GAS EXHAUST LINE IN CASTING MACHINE AND METHOD THEREFOR

BACKGROUND OF THE INVENTION

The present invention relates to an apparatus and method for detecting defects at a gas exhaust line in a casting machine, and more particularly, to the apparatus and method for detecting clogging or perforation at the gas exhaust line in the casting machine.

Conventionally, there have been proposed various gas venting techniques for venting gas from metal molds in order to produce voidless product in casting with an injection machine such as a die-casting machine. According to the conventional techniques, suction of gas from a mold cavity is positively performed by a vacuum suction device through a gas venting device and gas exhaust line in an attempt to remove gas from the mold cavity. However, gas suction may be insufficient if the gas venting device and the gas exhaust line do not perform proper sucking operation due to their defects such as clogging. Accordingly, gas venting passage may be closed, and quality of the casted product may be degraded, and productivity may be lowered. To obviate this problem, there have also been conventionally proposed a detecting apparatus and detecting method for detecting defects such as clogging etc. in the gas venting device and the gas exhaust line.

For example, according to a Japanese Patent Application Kokai No. sho-62-137164, a spool valve is connected, through a gas exhaust line, to a gas venting device provided in the metal molds, and vacuum suction means such as a vacuum tank is connected to the spool valve through the gas exhaust line. A pressure switch is provided in the vacuum tank for detecting pressure within the suction means. The pressure switch is also connected to the spool valve through a timer and control means. When filling molten metal in the metal molds, the spool valve is opened for venting gas by means of negative pressure in the vacuum tank through the gas vent device. Inner pressure in the vacuum tank is detected by the pressure switch for checking clogging at the gas exhaust line.

If clogging occurs, the pressure in the vacuum tank, the pressure being detected by the pressure switch, does not lower to a preset level. If the pressure level does not lower to the preset level even after elapse of a predetermined time period set by the timer, the control means closes the spool valve for replacing or inspecting the gas exhaust line.

However, in the invention described in this Japanese publication, several drawbacks may be conceivable since the pressure switch is connected to the vacuum tank. For example, (1) if the vacuum tank has large internal volume, pressure dropping speed is low despite the fact that no clogging occurs, so that it would be difficult to judge whether or not the low pressure dropping speed is due to the clogging. (2) If the mold cavity has small internal volume, also, pressure drop speed in the vacuum tank is low, so that it would be difficult to distinguish the occurrence of clogging. (3) If cross-sectional area of the gas vent passage is small, it takes too much time to provide pressure drop in the vacuum tank, so that it would be difficult to judge whether or not the clogging occurs. (4) In order to perform proper detection of clogging, it is necessary to alter setting of the pressure switch in view of the reasons (1) through (3) above. (5) Even if clogging occurs, pressure drop in the vacuum tank also occurs if the gas discharge line is perforated, and thus, detection to the clogging cannot be achieved, and perforation or hole in the gas exhaust line cannot be found.

Further, according to a Japanese Utility Model Application Kokai No.62-193952, a checking vacuum tank is connected to a gas vent hole formed at a downstream of a gas vent valve of a gas vent device, and the checking vacuum tank is connected with a pressure switch. After the gas vent valve is open, the gas vent valve and the checking vacuum tank are communicated with each other, and the inner pressure of the checking vacuum tank is detected by the pressure switch for detecting opening/closing state of the gas vent valve.

However, the invention described in the Japanese Utility Model publication would provide the following problems: (1) If the checking vacuum tank has large internal volume, pressure level in the checking vacuum tank is unchanged even if the gas vent valve is open, so that judgment as to whether or not the clogging occurs or judgment of opening or closing state of the gas vent valve cannot be made. (2) If the mold cavity has small internal volume, pressure level in the checking vacuum tank is unchanged, and therefore, it is impossible to judge the state of the gas vent valve and to judge whether or not clogging occurs. (3) Due to the reason (2), pressure level must be altered with respect to each of the metal molds in order to detect the proper detection of clogging. (4) if the gas exhaust line is perforated while the gas vent valve is open and clogging occurs, the checking vacuum tank would provide the pressure change which is the same as that in case of the normal state. Thus, defect cannot be detected. (5) Proper checking vacuum tank must be required for detecting state of the gas vent valve and condition of clogging.

SUMMARY OF THE INVENTION

The present invention has been made in view of the above described drawbacks, and it is an object of the present invention to provide an apparatus and method for detecting defect of the gas exhaust line in the casting machine, the apparatus and method being capable of precisely detecting the defects regardless of the condition of the metal molds and internal volume of the vacuum tank.

To attain the object, the present invention provides an apparatus for detecting defects at a gas exhaust line in a casting machine including suction means, a change-over valve, pressure detection means and control means. The gas exhaust line is connected through a gas vent valve to a gas vent passage and a mold cavity provided upstream thereof in metal molds. The gas exhaust line is selectively connectable to the mold cavity by opening and closing motion of the gas vent valve. The suction means is connected to the gas exhaust line for sucking gas in the gas exhaust line when the gas vent valve is closed, and for sucking gas in the gas exhaust line through the mold cavity and through the gas vent valve when the gas vent valve is open. The change-over valve is connected to the gas exhaust line and is positioned between the gas vent valve and the suction means for selectively disconnecting the suction means from the gas vent valve. The pressure detection means is directly connected to the gas exhaust line for detecting pressure within the gas exhaust line. The control means is connected to the change-over valve for controlling change-over operation thereof. The control means is also connected to the pressure detection means for judging defects at the gas exhaust line.

In another aspect, according to the present invention there is provided a method for detecting defects at a gas exhaust line in a casting machine including the steps of sucking gas in the gas exhaust line connected through a gas vent valve to a gas vent passage and a mold cavity positioned upstream thereof in a metal mold of the casting machine, while the gas vent valve is closed, and determining that a hole is formed at the gas exhaust line if a pressure in the gas exhaust line does not reach a first predetermined pressure level within a first predetermined period.

Further, the present invention provides a method for detecting defects at a gas exhaust line in a casting machine including the steps of sucking gas in the gas exhaust line connected through a gas vent valve a gas vent passage and a mold cavity positioned upstream thereof in metal molds of the casting machine, while the gas vent valve is open, after the metal molds are open, and determining occurrence of clogging at the gas vent valve and the gas exhaust line when a pressure in the gas exhaust line exceeds a second predetermined pressure level within a second predetermined period.

According to the apparatus and method for detecting the defects of the gas exhaust line in the casting machine, the gas exhaust line undergoes suction by the suction means through the change-over valve during closing state of the gas vent valve. If clogging occurs at the gas vent valve and the gas exhaust line, the pressure level detected by the pressure detection means exceeds a predetermined decompression level, so that the judgment falls clogging. The pressure detection means is directly connected to the gas exhaust line, and therefore, pressure change can be easily detected.

If the gas exhaust line undergoes suction, through the change-over valve by the suction means during closing state of the gas vent valve, the gas exhaust line is gradually decompressed to reach the predetermined decompression level provided that there is no hole in the gas exhaust line. On the other hand, if the line is perforated, decompression level does not reach the predetermined level, to make judgment that there is a hole in the gas exhaust line.

BRIEF DESCRIPTION OF THE DRAWINGS

In the drawings:

FIG. 2 is a flowchart showing a process for detecting defect at the gas exhaust line according to the one embodiment.

DETAILED DESCRIPTION OF THE PREFERRED EMBODIMENTS

Figure 1:
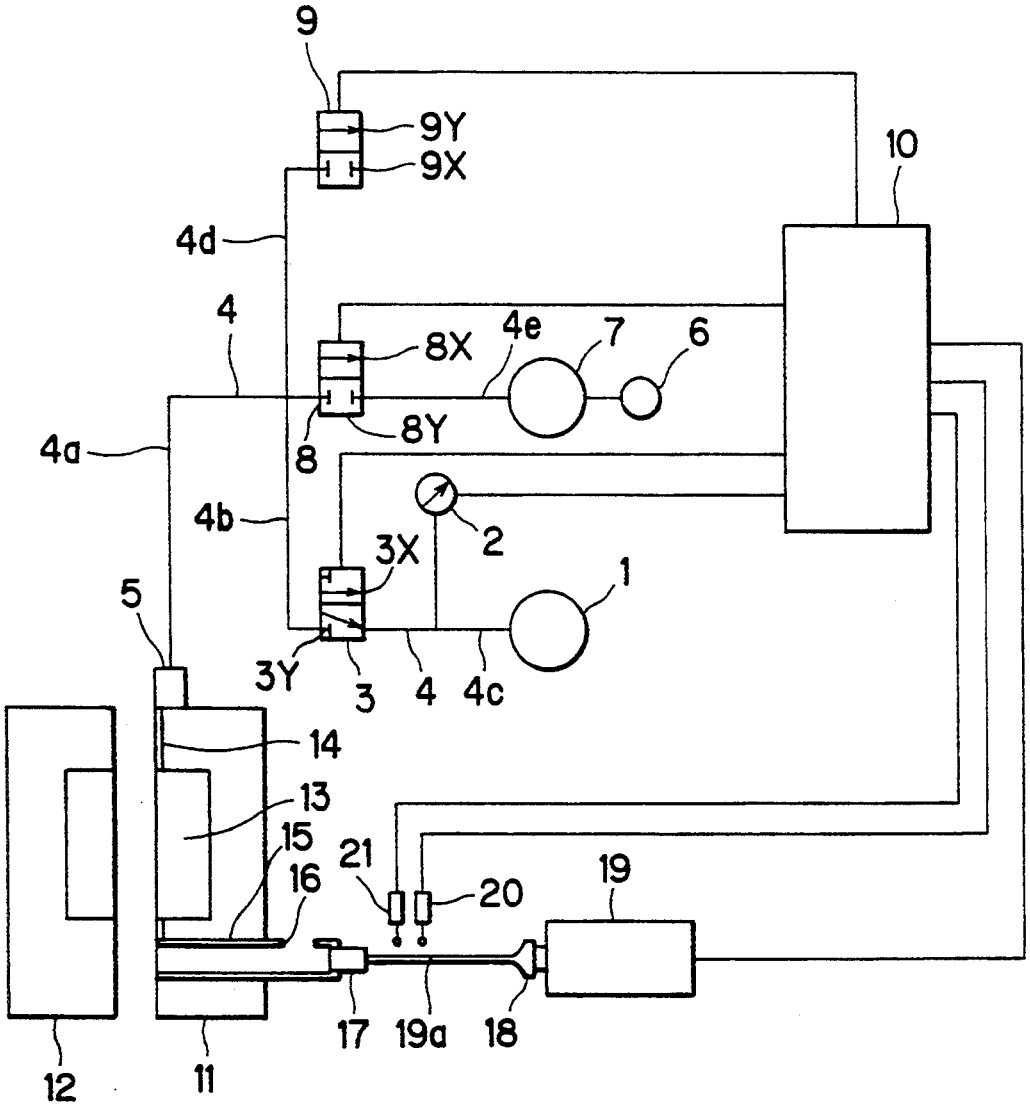
FIG. 1 is a schematic view showing an apparatus for detecting defects at a gas exhaust line in a casting machine according to one embodiment of the present invention.

An apparatus for detecting the defects of a gas exhaust line in a casting machine according to one embodiment of the present invention will be described with reference to FIG. 1.

A casting machine such as a die-casting machine has a stationary metal mold 11 and a movable metal mold 12 movable relative to the stationary metal mold 11, and a mold cavity 13 is defined between the metal molds 11 and 12. The mold cavity 13 is communicated with an injection sleeve 15 having a pouring port 16, and an injection plunger 17 is slidably disposed in the injection sleeve 15. The injection plunger 17 is driven by an injection cylinder 19 through a cylinder rod 19*a* to which a striker 18 is provided. The striker 18 is provided at a position abutable against a vacuum start limit switch 20 and high speed limit switch 21 during moving stroke of the cylinder rod 19*a*. These limit switches 20, 21 are connected to a control circuit 10.

A gas vent device is adapted for discharging gas out of the metal molds by the negative pressure, the gas having been existing in the metal molds or generated at the time of pouring. The gas vent device includes a gas vent valve 5 connected to a gas vent passage 14 formed in the stationary metal mold 11 and in communication with the mold cavity 13, a first electromagnetic valve 8 connected to the gas vent valve 5, a vacuum tank 7 connected to the first electromagnetic valve 8, and a vacuum pump 6 connected to the vacuum tank 7. These are connected to each other by a gas exhaust line 4 (4*a*, 4*e*). The first electromagnetic valve 8 is connected to the control circuit 10, which generates change-over signals for moving the first electromagnetic valve 8 into a first change-over position 8X where the vacuum tank 7 is communicated with the gas vent valve 5 and for moving the valve 8 into a second change-over position 8Y where the communication between the tank 7 and the gas vent valve 5 is shut-off.

An apparatus for detecting the defects at the gas exhaust line generally includes second and third electromagnetic valves 3, 9, a pressure switch 2 and a suction unit (blower) 1. The second electromagnetic valve 3 is connected to the gas vent valve 5 by way of a gas exhaust line 4 (4*a*, 4*b*), and the suction unit 1 is connected to the second electromagnetic valve 3 by way of the gas exhaust line 4 (4*c*). The pressure switch 2 connected to the control circuit 10 is directly connected to the gas exhaust line 4*c* connecting the second electromagnetic valve 3 to the suction unit 1. The second electromagnetic valve 3 is connected to the control circuit 10, which generates change-over signals for moving the second electromagnetic valve 3 into a first change-over position 3X where the gas vent valve 5 is communicated with the suction unit 1 and for moving the valve 3 into a second change-over position 3Y where the communication between the gas vent valve 5 and the suction unit is shut-off.

Pressure level to be detected can be set in the pressure switch 2. The pressure switch is adapted to generate and output a detection signal to the control circuit 10 when the switch detects the preset pressure level. Further, the third electromagnetic valve 9 is connected, at a position upstream of the first and second electromagnetic valves 8, 3, to the gas vent valve 5 through the gas exhaust line 4 (4*a*, 4*d*). The third electromagnetic valve 9 is connected to the control circuit 10, which generates change-over signals for moving the third electromagnetic valve 9 into a first change-over position 9X where the gas exhaust line 4 is disconnected from an atmosphere, and for moving the valve 9 into a second change-over position 9Y where the gas exhaust line 4 is communicated with the atmosphere.

Next, detecting operation for detecting defects at the gas exhaust line in the casting machine will be described with reference to a flowchart shown in FIG. 2. In the flowchart, "electromagnetic valve 3 open" and "electromagnetic valve 8 open" imply that the control circuit 10 outputs change-over signal for moving these valves into their first change-over positions 3X and 8X, and "electromagnetic valve 9 open" implies that the control circuit 10 outputs the change-over signal for moving the valve 10 into its second change-over position 9Y. Similarly, "electromagnetic valve 3 close" and "electromagnetic valve 8 close" imply that the control circuit 10 outputs change-over signal for moving these valves into their second change-over positions 3Y and 8Y, and "electromagnetic valve 9 close" implies that the control circuit 10 outputs the change-over signal for moving the valve 10 into its first change-over position 9X.

Before the casting operation, the gas vent valve 5 is open, and the first electromagnetic valve 8 is positioned at its second change over position 8Y where the vacuum tank 7 is disconnected from the gas vent valve 5. Further, the second electromagnetic valve 3 is positioned at its first change-over position 3X where the suction unit 1 is communicated with the gas vent valve 5. Furthermore, the third electromagnetic valve 9 is positioned at its first changeover position where the gas exhaust line 4 is disconnected from the atmosphere.

With this state, in Step S1, if a start switch (not shown) of the casting machine is turned ON, the molten metal is poured through the pouring port 16, and the injection cylinder 19 is operated to move the cylinder rod 19*a* frontwardly. Then in Step S2, the second electromagnetic valve 3 is changed-over to the second change-over position 3Y, so that the suction unit 1 is disconnected from the gas vent valve 5. Next, in Step S3, when the striker 18 abuts the vacuum start limit switch 20, the control circuit 10 generates the change-over signal to the first electromagnetic valve 8, so that the first electromagnetic valve 8 is changed-over to its first change-over position 8X. Thus, negative pressure is applied for sucking gas within the mold cavity 13 and the gas vent passage 14. The sucked gas is introduced into the vacuum tank 7.

When the striker 18 abuts the high speed limit switch 21, the driving speed of the injection cylinder is increased for moving the injection plunger 17 at high speed, to thus prompt filling of the molten metal into the mold cavity. Then in Step S4, the gas vent valve 5 is closed at a predetermined timing so as to prevent the molten metal from leaking therethrough, to thus complete the molten metal filling.

Next in Steps S5 through S10, checking to the perforation in the gas exhaust line 4 is carried out. That is, in the Step S5, introduction of the negative pressure into the gas exhaust line 4 is terminated by changing-over the first electromagnetic valve 8 into its second change-over position 8Y. Next, in Step S6, the third electromagnetic valve 9 is changed-over to its second change-over position 9Y, so that atmospheric pressure is applied into the gas exhaust line 4*a*, 4*b*, 4*d*. After the gas exhaust line 4*a*, 4*b*, 4*d* has the atmospheric pressure, the third electromagnetic valve 9 is changed-over to its first change-over position 9X in Step S7. In this state, since the gas vent valve 5 is closed, the gas exhaust line 4*a*, 4*b*, 4*d* is disconnected from the atmosphere with maintaining the atmospheric pressure.

Next, in Step S8, the second electromagnetic valve 3 is changed-over to its first change-over position 3X to introduce negative pressure into the gas exhaust line. Thus, in Step S9, detection to the perforation at the gas exhaust line 4 is carried out. That is, if no perforation is formed in the gas exhaust line 4, the pressure in the gas exhaust line 4 is gradually reduced, and the pressure reaches the predetermined pressure preset by the pressure switch 2. On the other hand, if there is perforation in the exhaust line 4, atmospheric pressure is suckedly introduced into the gas exhaust line 4 through the perforation, and therefore, the inner pressure in the exhaust line does not reach the preset level. Incidentally, a period for detecting the perforation is previously set by a timer (not shown) at the control circuit 10. If the inner pressure does not reach the preset pressure within the preset period, the judgment falls that there is perforation in the gas exhaust line in Step S9. Then, the routine goes into Step S10 to terminate the processing. Thereafter, a gas exhaust pipe or connection hose which constitute the gas exhaust line 4 are replaced by new pipes or hose.

In the Step S9, if judgment falls that no perforation is formed in the gas exhaust line, the routine proceeds into Step S11 where the second electromagnetic valve 3 is moved to its second change-over position 3Y for stopping decompression in the gas exhaust line 4. In this state, since negative pressure is applied in the gas exhaust line 4, opening motion of the gas vent valve 5 (which will be performed in a later step S15) cannot be performed. Therefore, in Step S12, the third electromagnetic valve 9 is moved to its second change-over position 9Y to introduce atmospheric pressure into the gas exhaust line 4. Then, in Step S13 the third electromagnetic valve 9 is moved to its first change over position 9X. With this state, metal mold opening is performed for taking out a casted product in the mold cavity 13.

Then, in Step S14, judgment is made as to whether or not air blowing signal is outputted for cleaning the metal mold. If output (S14: Yes), the routine goes into Step S15 to start detecting operation for detecting clogging within the gas vent valve 5 and the gas exhaust line 4. That is, in the Step S15, a valve opening signal is transmitted to the gas vent valve 5, and in Step S16, the second electromagnetic valve 3 is moved to its first change-over position 3X. In this state, the first electromagnetic valve 8 is at its second change-over position 8Y, and the third electromagnetic valve 9 is at its first change-over position 9X. Thus, atmospheric pressure is introduced into the exhaust line 4 through the gas vent valve 5 at the metal mold which is open. Then, in Step S17, judgment is made as to whether or not clogging occurs in such fluid passage.

That is, if clogging occurs at the fluid passage (S17: Yes), cross-sectional area of the passage is reduced to increase air flowing speed, so that pressure drops because of the Bernoulli's effect. Consequently, if the pressure level exceeds the predetermined reduced pressure level preset in the pressure switch 2 within a predetermined period, judgment falls that clogging occurs. If clogging is detected, the routine goes into Step S18 to stop the processing for replacing the gas vent valve 5 and the gas exhaust line such as the exhaust pipe and connection hose.

On the other hand, if clogging is not detected (S17; No), metal molds are closed to proceed into Step S19 to make judgment as to whether or not a casting stop button is turned ON. If not turned ON (S19: No), the routine returns back to the Step S1 to repeat the same processing. If the stop button is turned ON, the processing is finished.

In view of the foregoing, in the apparatus and method for detecting defects at the gas exhaust line in the casting machine, the detection to clogging can be made regardless of the state of the metal molds which are positioned upstream of the gas vent valve, since the gas exhaust line which is positioned downstream of the metal molds is subjected to sucking. Therefore, precise detection to clogging can be performed.

Further, since the pressure switch is directly connected to the gas exhaust line constituted by the tubular fluid passage to detect the pressure level in the tubular passage, pressure change due to the clogging easily occurs, and therefore, accurate detection to clogging can be performed by detecting the changing pressure. In other words, in contrast to the conventional arrangement, since the pressure switch is not connected to the vacuum tank, the pressure detection can be made regardless of the internal volume of the vacuum tank. Even if the vacuum tank has large internal volume or the mold cavity has a small internal volume, clogging can be detected.

Further, even if the gas vent passage has a small cross-sectional area, clogging can be detected. Furthermore, checking vacuum tank is not required to provide a compact arrangement. Moreover, alternation of the setting to the pressure switch is not required to enhance operability. At the time of closing state of the gas vent valve, perforation at the gas exhaust line can also be detected by sucking gas in the gas exhaust line. During detection of clogging, the gas vent valve is open, so that molten metal piece which may be adhered onto a valve seat of the gas vent valve can be suckedly removed. Therefore, can be avoided entry of the molten metal into the gas vent valve due to the adhesion of the molten metal solidified at the seat.

While the invention has been described in detail and with reference to the specific embodiment thereof, it would be apparent to those skilled in the art that various changes and modifications may be made therein without departing from the spirit and scope of the invention.

What is claimed is:

1. An apparatus for detecting defects at a gas exhaust line in a casting machine, the gas exhaust line being connected through a gas vent valve to a gas vent passage and a mold cavity provided upstream thereof in metal molds, the gas exhaust line being selectively connectable to the mold cavity by opening and closing motion of the gas vent valve; and the improvement comprising:

suction means connected to the gas exhaust line for sucking gas in the gas exhaust line when the gas vent valve is closed, and for sucking gas in the gas exhaust line through the mold cavity and through the gas vent valve when the gas vent valve is open:

a change-over valve connected to the gas exhaust line and positioned between the gas vent valve and the suction means for selectively disconnecting the suction means from the gas vent valve;

pressure detection means directly connected to the gas exhaust line for detecting pressure within the gas exhaust line; and control means connected to the change-over valve for controlling change-over operation thereof and connected to the pressure detection means for judging defects at the gas exhaust line.

2. The apparatus as claimed in claim 1, wherein the control means judges existence of at least one perforation or hole at the gas exhaust line as one of the defects, a first predetermined decompressed pressure level being settable in the pressure detection means, and the control means detecting the perforation when the pressure level detected by the pressure detection means does not reach the first predetermined decompressed pressure level within a first predetermined period when the gas vent valve is closed and the change-over valve is open.

3. The apparatus as claimed in claim 1, wherein the control means judges occurrence of clogging in the gas exhaust line as one of the defects, a second predetermined pressure level being settable in the pressure detection means, and the control means detecting the occurrence of the clogging when the pressure level detected by the pressure detection means exceeds the second predetermined pressure level within a second predetermined period when the gas vent valve and the change-over valve are open.

4. The apparatus as claimed in claim 2, wherein the control means judges occurrence of clogging in the gas exhaust line as one of the defects, a second predetermined pressure level being settable in the pressure detection means, and the control means detecting the occurrence of the clogging when the pressure level detected by the pressure detection means exceeds the second predetermined pressure level within a second predetermined period when the gas vent valve and the change-over valve are open.

5. A method for detecting defects at a gas exhaust line in a casting machine comprising the steps of:

sucking gas in the gas exhaust line connected through a gas vent valve to a gas vent passage and a mold cavity positioned upstream thereof in a metal mold of the casting machine, while the gas vent valve is closed;

detecting gas pressure directly from the gas exhaust line through a gas pressure detecting means which is directly connected to the gas exhaust line; and determining that a hole is formed at the gas exhaust line when the pressure in the gas exhaust line does not reach a first predetermined pressure level within a first predetermined period.

6. A method for detecting defects at a gas exhaust line in a casting machine comprising the steps of:

sucking gas in the gas exhaust line connected through a gas vent valve, a gas vent passage and a mold cavity positioned upstream thereof in metal molds of the casting machine, while the gas vent valve is open, after the metal molds are open;

detecting gas pressure directly from the gas exhaust line through a gas pressure detecting means which is directly connected to the gas exhaust line; and determining occurrence of clogging at the gas vent valve and the gas exhaust line when a pressure in the gas exhaust line exceeds a second predetermined pressure level within a second predetermined period.

* * * * *